US006302509B1

(12) United States Patent
Iwasaki et al.

(10) Patent No.: US 6,302,509 B1
(45) Date of Patent: Oct. 16, 2001

(54) INK-JET APPARATUS AND METHOD OF ESTIMATING AND CONTROLLING TEMPERATURE OF INK-JET HEAD THEREOF

(75) Inventors: Osamu Iwasaki, Tokyo; Naoji Otsuka, Yokohama; Kiichiro Takahashi, Kawasaki; Hitoshi Nishikori, Inagi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/059,266

(22) Filed: Apr. 14, 1998

(30) Foreign Application Priority Data

Apr. 15, 1997 (JP) ..... 9-096866

(51) Int. Cl.[7] ..... B41J 29/38; B41J 2/365

(52) U.S. Cl. ..... 347/17; 347/14; 347/195

(58) Field of Search ..... 347/14, 17, 194, 347/195, 196, 19, 15

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,587,530 | * | 5/1986 | Noguchi | 347/195 |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 4,849,774 | * | 7/1989 | Endo et al. | 347/56 |
| 4,860,027 | * | 8/1989 | Ozelis et al. | 347/7 |
| 5,315,316 | * | 5/1994 | Khormaee | 347/3 |
| 5,339,099 | * | 8/1994 | Nureki et al. | 347/180 |
| 5,559,535 | * | 9/1996 | Otsuka et al. | 347/14 |
| 5,625,384 | | 4/1997 | Numata et al. | 347/23 |
| 5,731,828 | * | 3/1998 | Ishinaga et al. | 347/62 |
| 5,877,785 | * | 3/1999 | Iwasaki et al. | 347/14 |

FOREIGN PATENT DOCUMENTS

| | | | |
|---|---|---|---|
| 0 505 154 | | 9/1992 | (EP) . |
| 0 526 223 | | 2/1993 | (EP) . |
| 709 197 | * | 1/1996 | (EP) . |
| 0 709 197 | | 5/1996 | (EP) . |
| 0 719 647 | | 7/1996 | (EP) . |
| 54-56847 | | 5/1979 | (JP) . |
| 59-123670 | | 7/1984 | (JP) . |
| 59-138461 | | 8/1984 | (JP) . |
| 60-71260 | | 4/1985 | (JP) . |
| 5-208505 | | 8/1993 | (JP) . |
| 07125216 | * | 5/1995 | (JP) . |
| 7-125216 | | 5/1995 | (JP) . |

* cited by examiner

*Primary Examiner*—Huan Tran
*Assistant Examiner*—Blaise Mouttet
(74) *Attorney, Agent, or Firm*—Fitzpatrick, Cella, Harper & Scinto

(57) ABSTRACT

In an ink-jet apparatus for forming images through use of an ink-jet head provided with a plurality of ink ejection heaters with respect to only one ejection orifice, an accurate estimation of temperature of the ink-jet head is made possible by controlling ink-ejection amount in a step-by-step manner. For this purpose, there is provided a device for counting frequency of use of the plurality of heaters within a predetermined period of time independently for each combination of the heaters for ejecting different amount of ink (in steps S1002, S1003), and a combining device for adding a correction value to each of the thus counted value on the basis of the heater driving condition, and converting the total value into the energy applied within a predetermined period (in steps S1008, S1004 and S1005). The estimation of temperature is performed by use of the thus obtained energy.

18 Claims, 12 Drawing Sheets

INK-JET APPARATUS AND METHOD OF ESTIMATING AND CONTROLLING TEMPERATURE OF INK-JET HEAD THEREOF

This application is based on Patent Application No. 9-096,866 filed Apr. 15, 1997 in Japan, the content of which is incorporated hereinto by reference.

BACKGROUND OF THE INVENTION

1. Field of the Invention

The present invention relates to an ink-jet apparatus and a method of controlling an ink-jet head for use in the ink-jet apparatus, and more particularly to an ink-jet apparatus adopting an ink-jet head that uses thermal energy for ejecting liquid, and also a method of controlling the ink-jet head through estimation of the temperature thereof.

2. Description of the Related Art

An ink-jet method capable of applying extremely small quantity of liquid to a printing medium has been often used so far in various fields such as letter printing, image printing, textile printing and so on, and is now expected to be applied to other fields, so that it is admitted as a very practical technique.

For example, due to a recent diffusion of personal computers, word processors, facsimile apparatuses and so on to many offices and individual homes, various printers respectively adopting different recording methods have been developed as the output apparatuses for those machines. Among these output apparatuses, since a printing apparatus adopting an ink-jet printing method has various benefits such as its low noise, its capability of outputting a high-quality print on a printing medium of various types, and also its small size and so on, it is optimum for a personal use even in offices. Among those ink-jet printing methods, a thermal method such as bubble-jet method (which is proposed by CANON INC.) having rapid drivability in response to a request for its activation has now become the most widely diffused method. The printing apparatus adopting this method first converts electric signals to thermal energy by use of heating elements at the print head portion, and causes nucleate or film boiling with respect to the ink, and thereafter utilizes the pressure thus generated to eject the ink onto the printing medium.

An ink drop applied onto the printing medium is expanded to form a dot. An image is formed by a set of formed dots and it is thus printed on the printing medium. The area of each dot greatly depends on the size of the ink drop, namely, the ink-ejecting amount. Therefore, the most important factor for acquiring a high-quality print adopting the ink-jet printing method is to control the amount of ink ejection.

The amount of ink ejection is closely related with the temperature of ink or the ink-jet head, and increases in accordance with a rise of temperature. For this reason, the critical problem from the technical viewpoint for acquiring a high-quality print is to control the temperature of ink or ink-jet head As one of the means for detecting the temperature of ink-jet head of the thermal method, providing a temperature sensor to the ink-jet head is widely adopted. However, for providing a temperature sensor, there exist some problems to be considered such as the rise of the total cost that may be caused by attaching a means for amplifying or modulating the electric signal corresponding to the thus detected temperature or a noise avoiding means, and an adverse effect which may possibly be caused by a temperature inclination derived from the distance between the position of the portion to be actually detected (such as a heating element on the head) and that of the temperature sensor.

In order to overcome these aforementioned problems, the assignee of this invention has disclosed a method of obtaining the temperature of the ink-jet head by a means for obtaining ambient temperature around the printing device or ink-jet head by using a sensor or the like, and also by a means for estimating a rise of temperature of the ink-jet head from the amount of heat applied to the ink-jet head within a predetermined period of time, as is disclosed in the Japanese Patent Application Laying-open No. 5-208505 and No. 7-125216.

On the other hand, as an ink-jet head adopting the thermal method, one that includes a plurality of ink ejecting heaters (hereinafter may be referred to just as ejection heaters) provided with respect to only one ejection orifice has been proposed. The ink-jet head of this type can control the amount of ink ejection in a step-by-step manner by changing the number of ejection heaters used for one ink ejecting operation. Moreover, in this type of ink-jet head, if a very detailed printing is required, a high-resolution image can be realized by forming ink dots made of relatively small ink-ejecting amount, whereas in a case in which a so-called "full-dot" or "solid" printing is required, the printing efficiency can be improved by forming the ink dots by making the ink ejecting amount relatively large.

However, in the aforementioned ink-jet heads to which a plurality of ink ejection heaters are provided, it has not yet been proposed that the temperature rise of an ink-jet head is estimated from the amount of heat applied thereto within a predetermined time of period in order to obtain the temperature thereof, and the temperature detecting method in the case of providing only one ejection heater with respect to only one ejection orifice can not be applied as it is.

SUMMARY OF THE INVENTION

The present invention has been achieved to solve the above-described problem and an object of the present invention is to provide an ink-jet apparatus capable of estimating with high-accuracy the temperature of an ink-jet head used therein provided with a plurality of ejection heaters, and also capable of relevantly controlling the ink-jet head on the basis of this temperature estimation, together with a method of controlling the ink-jet head.

In order to solve the problems aforementioned, an ink-jet apparatus using an ink-jet head having a plurality of heating elements with respect to only one ejection orifice that generate thermal energy used for ejecting ink, or a method of estimating temperature of the ink-jet head comprising: a means or step for counting the driving frequencies of the plurality of heating elements within a predetermined period of time for each group of combination of the plurality of heating elements which are selectively driven at the ink ejecting time, a means or step for combining driving frequency for correcting the counted value for each group of combination and summing the thus corrected values; and a means or step for estimating the change of temperature of the ink-jet head from the summed total value.

Here, the means or step for estimating temperature may make the summed total value to correspond to energy applied to the ink-jet head within the predetermined period of time.

Further, the means or step for estimating the temperature can be constructed such that it comprises a means or step for converting the summed value made by the activation frequency combining means into i pieces of value $\Delta Qi$ ($i \geqq 1$) that corresponds to a thermal amount applied to the ink-jet head within the predetermined period of time; a means or step for multiplying a predetermined value Ei by a value $\Delta Ti(n-1)$ that corresponds to the accumulated thermal amount of the ink-jet head before the predetermined period of time; a means or step for adding the value $\Delta Qi$ to the resultant value of the multiplication; a means or step for recording the added up value as a value $\Delta Ti(n)$ that corresponds to the accumulated thermal amount of the ink-jet head; and a means or step for calculating a change of temperature from i pieces of the value $\Delta Ti(n)$ that corresponds to the accumulated thermal amount of the ink-jet head.

Further, the above means or step for estimating the temperature can be constructed such that it further comprises a means or step for obtaining a change of temperature of the ink-jet head at each predetermined time lapse on the basis of the summed value obtained by the driving frequency combining means as individual values; and a means or step for obtaining a total change of temperature of the ink-jet head by accumulating the individual values calculated at the predetermined time lapses.

Still further, in the ink-jet apparatus or the control method thereof according to the present invention, a means or step for setting the driving condition of the heating elements from the change of temperature within the predetermined time period for each group of the combinations.

Still more, the means or step for setting the driving condition further comprises a means or step for changing the driving condition of the heating elements within the predetermined period of time for each group of the combinations.

Yet still further, the ink-jet apparatus or the control method thereof according to the present invention further comprises a means or step for detecting ambient temperature of the ink-jet head, and the means or step for changing modifies the driving condition of the heating elements within the predetermined period of time for each group of the combinations on the basis of the ambient temperature.

And still further, the ink-jet apparatus or the control method thereof according to the present invention further comprises a means or step for combining driving frequency, which further comprising a means or step for correcting the counted value for each group of combinations counted by the counting means in accordance with the driving condition of the heating elements within the predetermined period of time.

It is to be noted that in the present specification, the wording "print" (or may be hereinafter referred to just as "recording") is used not only for the case for forming information having meanings such as letters and figures, but is used also for forming images, patterns and so on by ejecting liquid onto a recording medium, or process the recording medium, regardless of whether the object to be made be feasible or visibly observed.

Still further, the wording "printing medium" does not mean only paper sheets generally used for recording devices, but also means cloths, plastic films, metals and so on which are all capable of receiving ink ejected from an ink-jet head.

Moreover, the wording "ink" should be comprehended as same as the definition of the above-mentioned wording "print", and thus, it should mean any kind of liquid used for forming images, patterns and so on by ejecting liquid onto a recording medium, or process the recording medium.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention is now explained into details with reference to the attached figures.

[First Embodiment]

Figure 1:
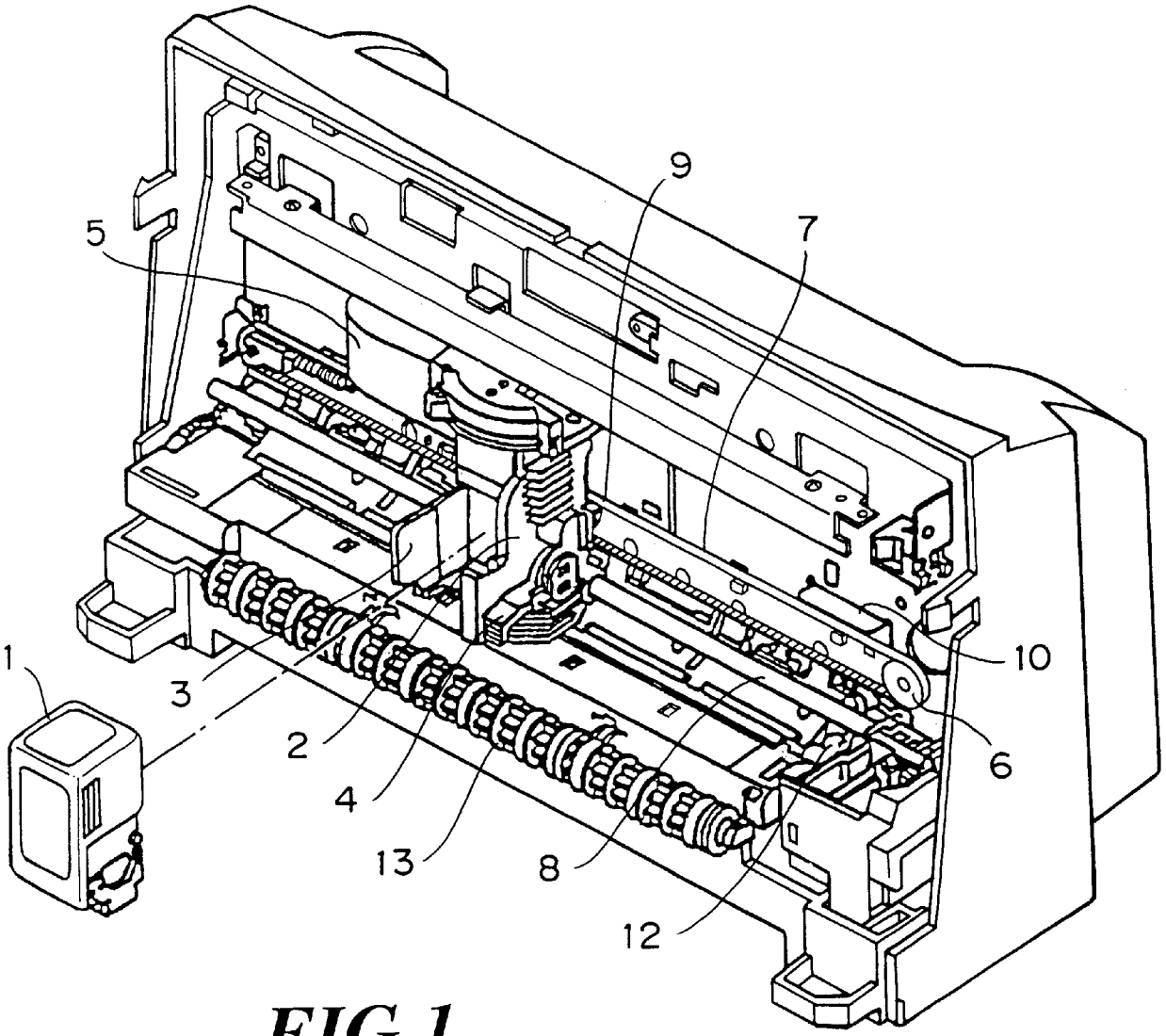
FIG. 1 is a perspective view showing one example of a construction of an ink-jet printer to which the present invention is preferably applied.

FIG. 1 is a perspective view showing one example of a configuration of a color ink-jet printing device (hereinafter may be referred to just as a printer), to which the present invention is preferably embodied or applied. The figure exposes inside the device with its front cover removed.

In the figure, reference numeral 1 denotes an ink-jet cartridge, and 2 denotes a carriage unit by which the color ink-jet cartridge 1 is removably retained. Reference numeral 3 denotes a holder for fitting the ink-jet cartridge 1 into the carriage unit 2, wherein when a cartridge fixing lever 4 is moved after the ink-jet cartridge 1 is installed into the carriage unit 2, the ink-jet cartridge 1 is press-contacted to the carriage unit 2 in connection with this movement. Further, while the ink-jet cartridge 1 is positioned by this press-contacting operation, an electrically contacting point for transmitting required signals provided in the carriage unit 2 and another electrical point provided in the ink-jet cartridge 1 are brought into contract to each other. Reference numeral 5 denotes a flexible cable for transmitting electrical signals to the carriage unit 2.

Reference numeral 6 denotes a carriage motor for reciprocally driving the carriage unit 2 in the main scanning direction, and 7 denotes a carriage belt for transmitting the driving force to the carriage unit 2. Numeral 8 denotes a guide shaft residing extendedly in the main scanning direction for supporting and guiding the shifting movement of the carriage unit 2. Numeral 9 denotes a transparent-type photo-coupler attached to the carriage unit 2, and numeral 10 denotes a light-screening plate provided near the carriage home position, whereby when the carriage unit 2 has reached the home position and interrupts the light axis of the photo-coupler 9, the carriage home position is detected. Reference numeral 12 denotes a home position unit including a cap member for covering the front surface of the ink-jet head, and also including a recovering system such as a suction member for sucking the whole area inside the cap.

Reference numeral 13 denotes a feeding roller driven by a line-feed unit (not shown) for feeding a printing medium, which nips the printing medium in cooperation with a spur-shaped roller (not shown) and expels the printing medium to outside the printing device.

Figure 2:
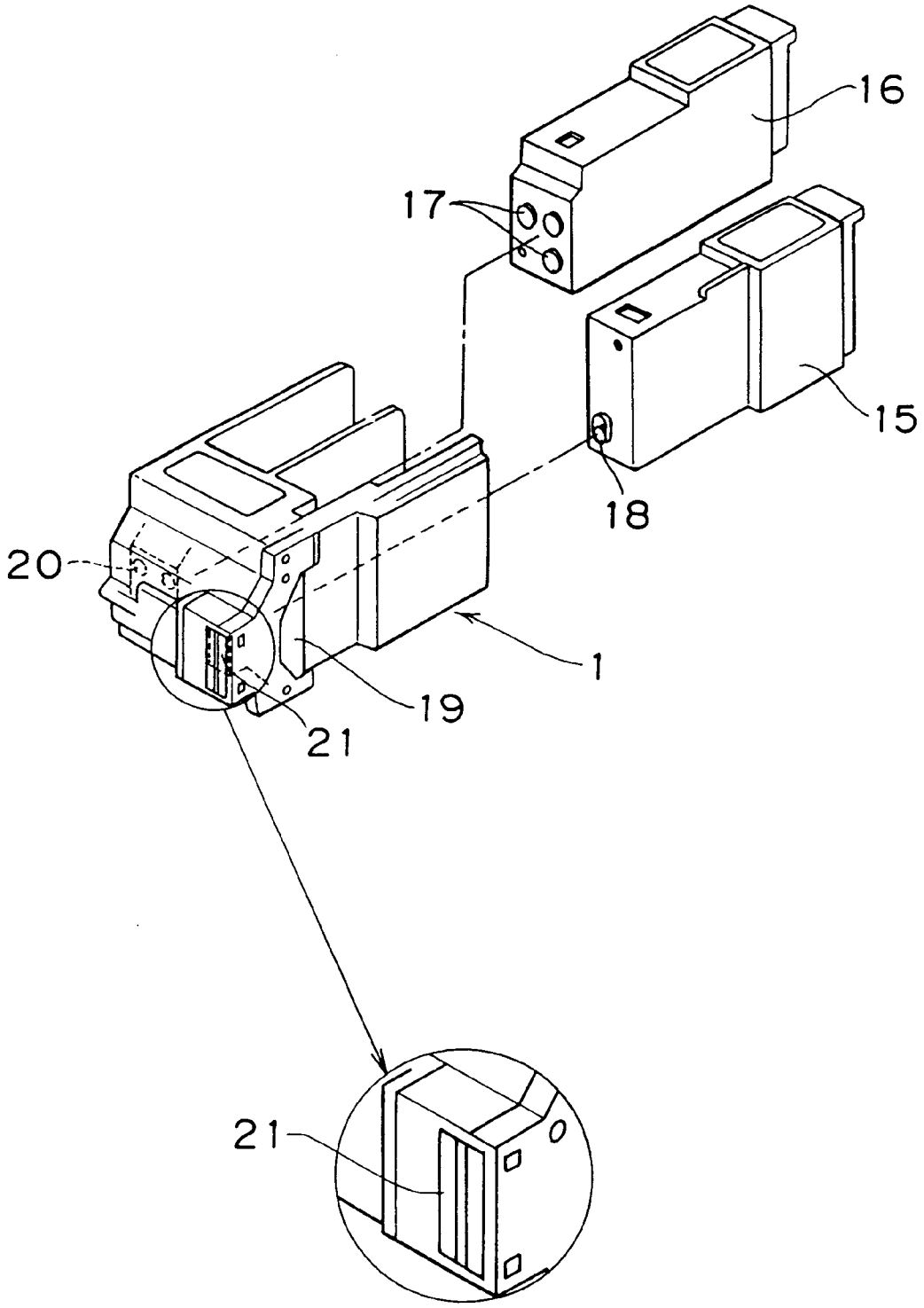
FIG. 2 is a perspective view showing a detail of the ink-jet cartridge used in the printer of FIG. 1.

FIG. 2 is a perspective view showing a detail of the ink-jet cartridge 1 used in the present embodiment. Here, reference numeral 15 denotes an ink reservoir containing black ink, whereas numeral 16 denotes an ink reservoir containing cyan, magenta and yellow ink. These ink reservoirs are removably accommodated into the body of the ink-jet cartridge. Further, numeral 17 denotes connecting ports for the ink reservoir 16 storing ink of the three colors, and are connected to an ink feeding pipe 20 provided in the main body of the ink-jet cartridge 1, whereas numeral 18 denotes a connecting port for the ink reservoir 15 storing black ink. By the connection of these ports, the ink of three different colors can be fed to the print head 21 retained by the ink-jet cartridge main body. Reference numeral 19 denotes an electrically contacting portion, and when it is brought into contact with the contacting portion provided to the carriage unit 2, electrical signals from the main assembly controlling section of the printing device are transmitted thereto by way of the flexible cable.

Figure 3:
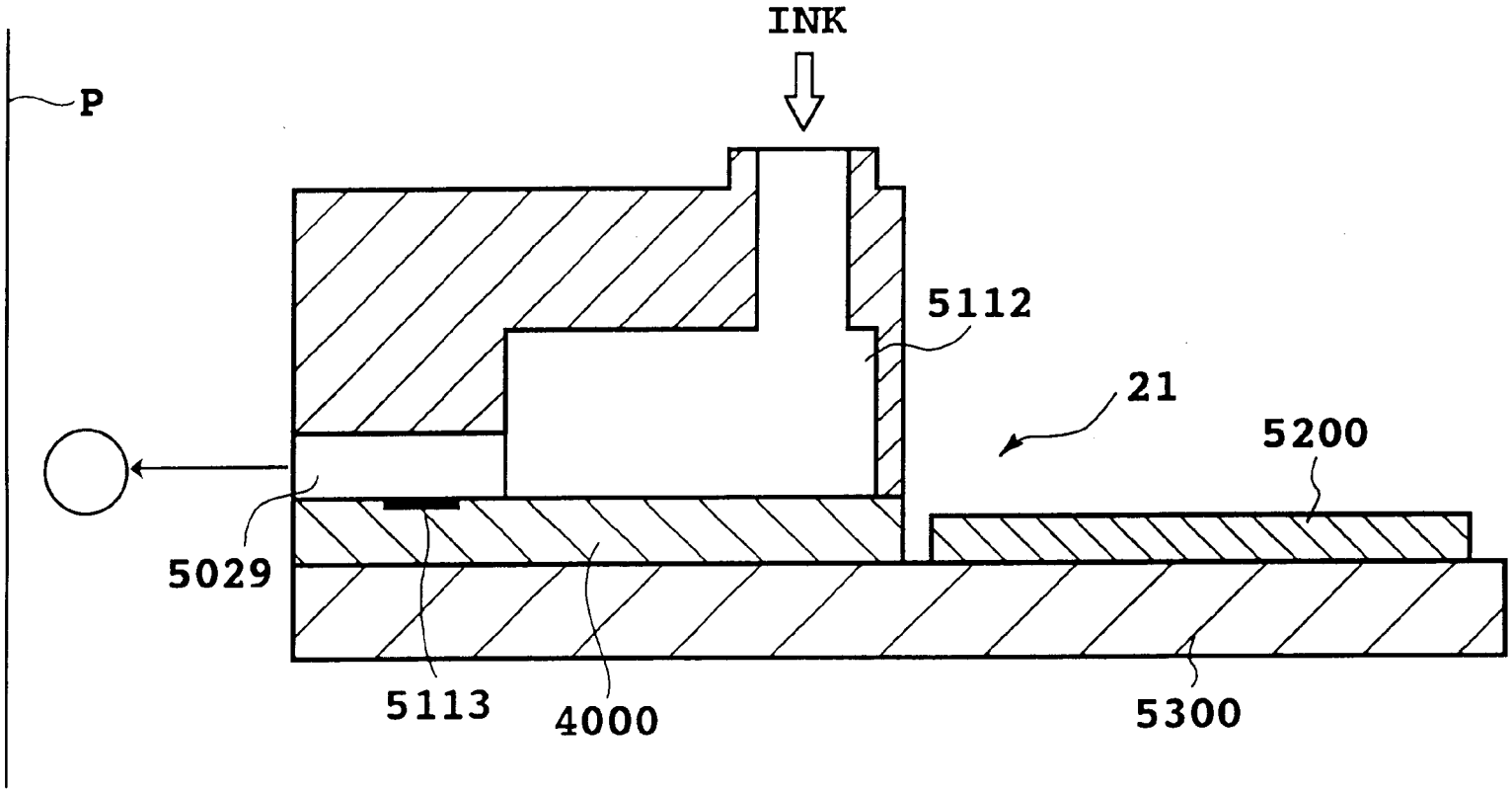
FIG. 3 is a schematic side sectional view showing a general construction of the print head of FIG. 2.
Figure 4:
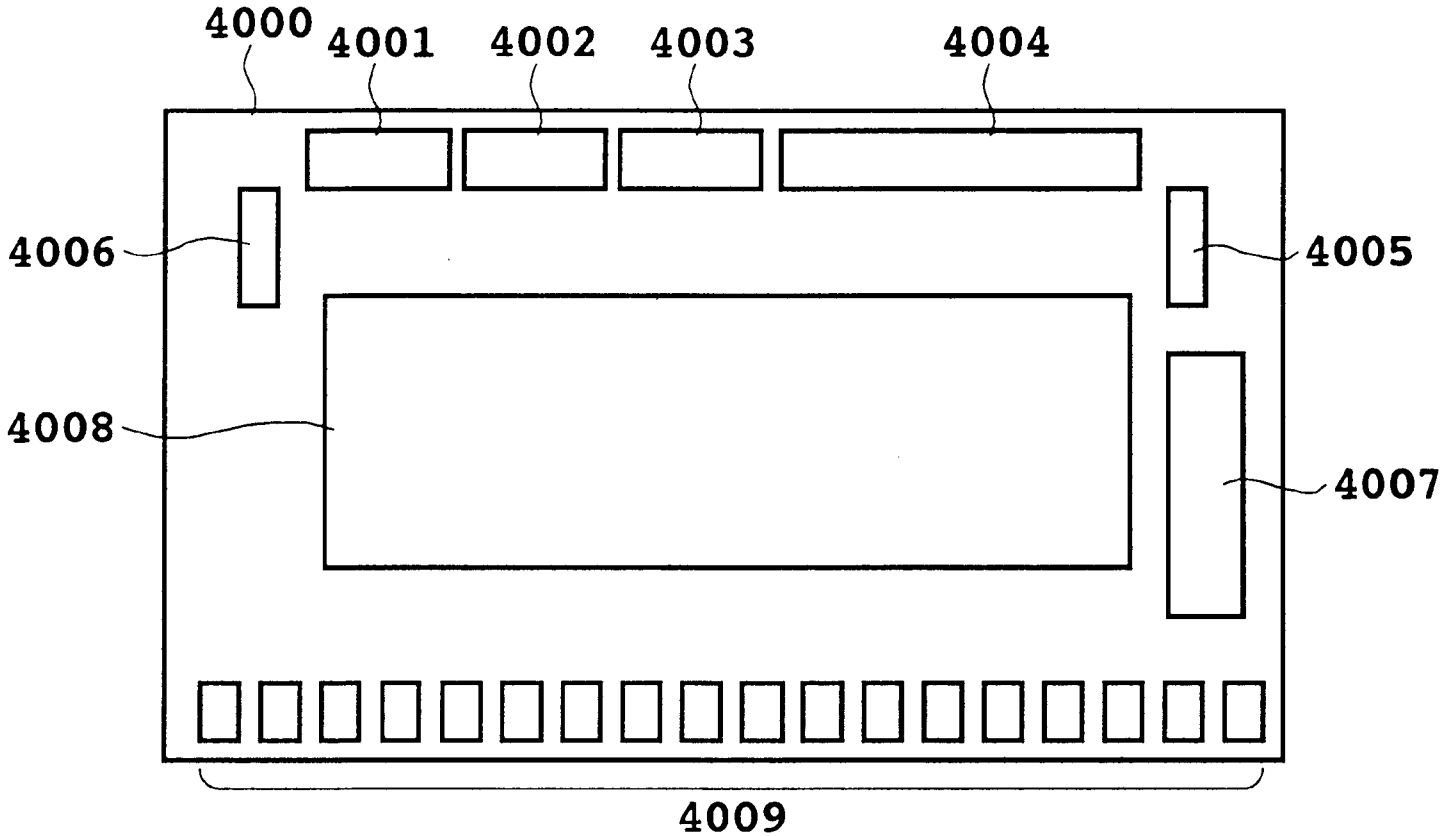
FIG. 4 is a schematic view showing a general construction of a heater board used in the print head of FIG. 3.

FIG. 3 is a schematic side sectional view showing a general construction of the print head 21, and FIG. 4 is a schematic view showing a general construction of a heater board used in the print head.

In FIG. 4, numeral 4000 denotes the base body of the heater board generally made of a silicon wafer chip. Numerals 4001, 4002, 4003 and 4004 are groups of ejection heaters (or simply ejection heater groups), respectively for ejecting cyan, magenta, yellow and black inks. Numerals 4005 and 4006 are heaters (hereinafter, each one is referred to just as an sub-heater) for heating up the heater board and the ink to a predetermined temperature, and are provided at the opposite lateral ends outside the range on the heater board within which the heater ejection groups are arranged. Numeral 4007 denotes a heater rank detecting section used for detecting resistive characteristic and the rank of the groups of ejection heaters and executing appropriate driving of the heater groups for the thus detected rank thereof (hereinafter referred to just as a rank heater). These ejection heater groups 4001, 4002, 4003 and 4004, sub-heaters 4005 and 4006, and also the rank heater 4007 are all formed by one semiconductor layer molding process.

Numeral 4008 denotes circuits including a shift register and a plurality of heater drivers used for controlling the ejection heaters, and are also formed by the semiconductor molding process. Numeral 4009 denotes a plurality of terminals for connecting a circuit board 5200 (FIG. 3), which includes an electrical contacting portion to make an electrical contact with the electrical contacting portion provided at the carriage unit 2, with the circuits on the heater board by use of a bonding wire or the like.

In FIG. 3, reference numeral 5113 denotes an ejection heater section as one of the components of the ejection heater groups, and is disposed at a position facing to the sole ejection orifice 5029 and also to liquid passage connected thereto. Numeral 5112 denotes a common liquid chamber for receiving ejection ink, which is connected to each of the liquid passages respectively connected to the ejection heater groups 4001, 4002, 4003 and 4004, and is further separated or divided into sections so that different inks are not mixed up therein.

Figure 5:
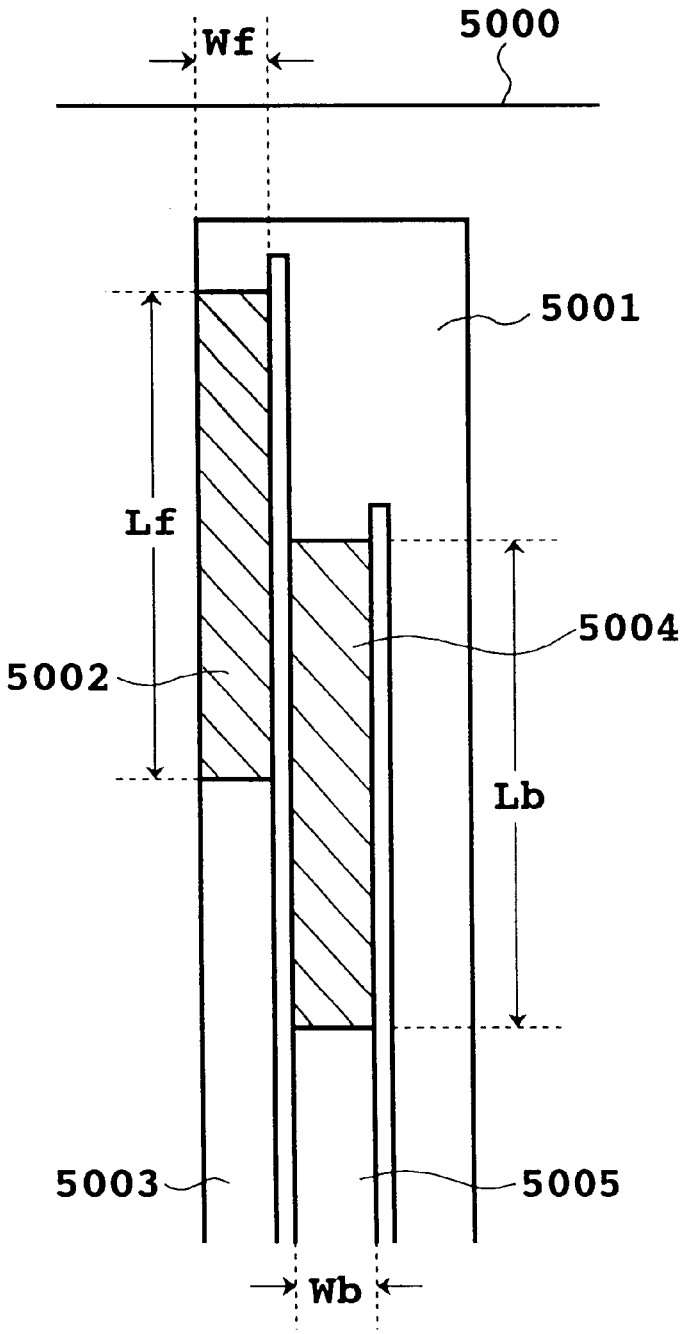
FIG. 5 is a schematic view showing a general construction of the ejection heaters formed on the heater board of FIG. 4.

FIG. 5 is a magnified view showing a construction of the ejection heater section 5113 as one example. Here, numeral 5000 denotes an edge of the heater board 4000, and a side face of this edge with respect to the ejection heater is a face on which the ink ejection orifice 5029 is arranged. In the present embodiment, the ejection heater section 5113 includes two ejection heaters; namely the heater 5002 and 5004. In this embodiment, the ejection heater 5002 residing in the front side toward the ejection orifice is structured such that its length Lf is 131 $\mu$m, and its width Wf is 22 $\mu$m, whereas the ejection heater 5004 residing at the rear side thereof is structured such that its length Lb is 131 $\mu$m, and its width Wb is 20 $\mu$m. Numeral 5001 denotes a common circuit for each of the heaters, and is connected to the ground line. Numerals 5003 and 5005 are individual circuits for selectively driving the heaters 5002 and 5004 respectively, and are connected to the heater drivers to switch on/off the heaters.

As explained above, the two ejection heaters 5002 and 5004 are provided with respect to one ejection orifice 5029. By this arrangement, when a high-resolution print is required, one of the ejection heaters is driven to generate bubbles only at the position corresponding thereto, so that a high-resolution print is performed by ink dots of a relatively small quantity of ejected ink. On the other hand, when only a full-dot print is required, the both heaters are driven to generate relatively large-sized bubbles that cover the corresponding entire portions to perform a full-dot printing by ink dots of a relatively large quantity of discharged ink, so that a printing efficiency is improved.

Figure 6:
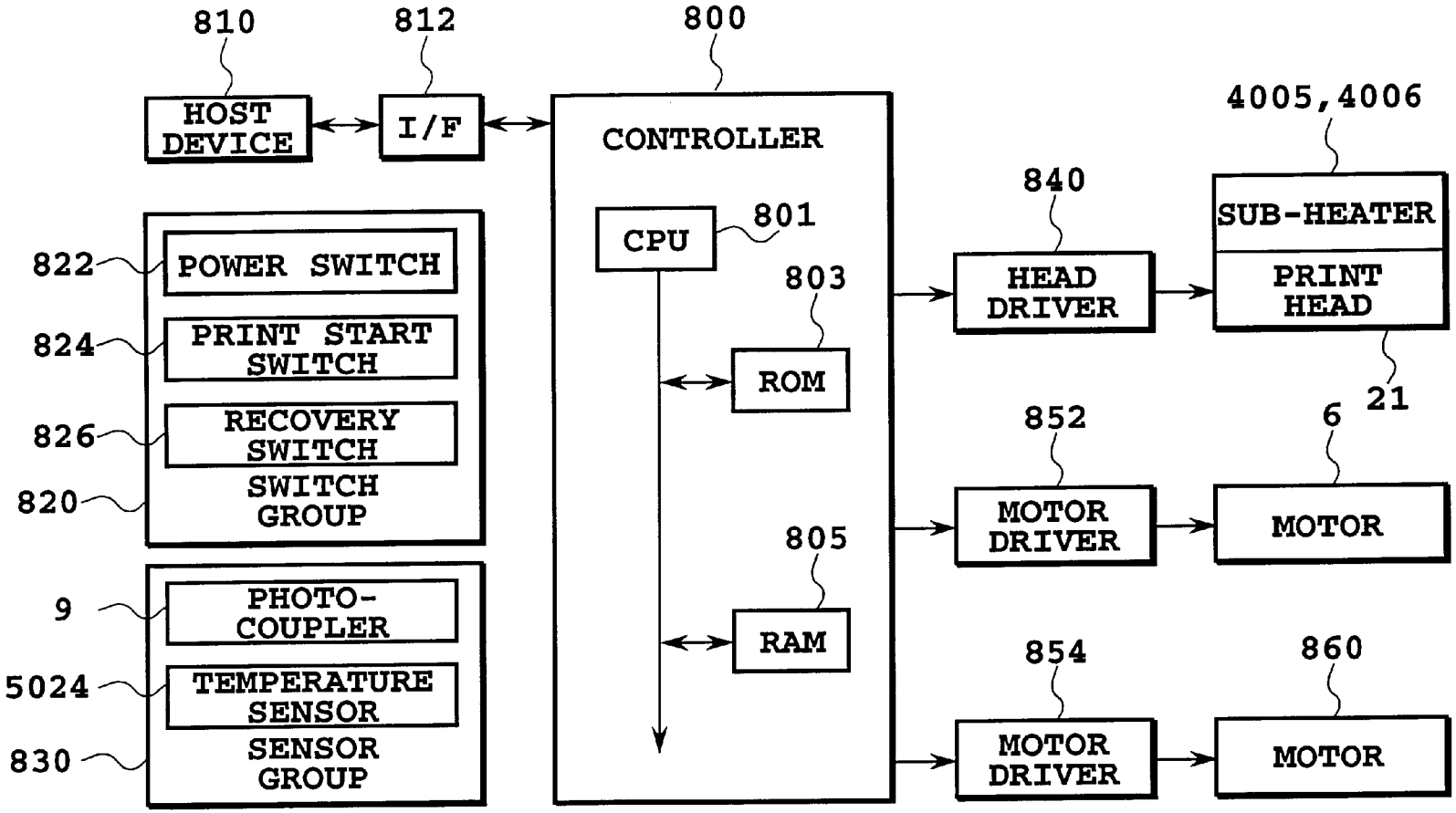
FIG. 6 is a schematic block diagram showing a general construction of a control system adopted in the printed of FIG. 1.

FIG. 6 shows a block diagram showing a control system of the above-explained ink-jet printing device.

Figure 7:
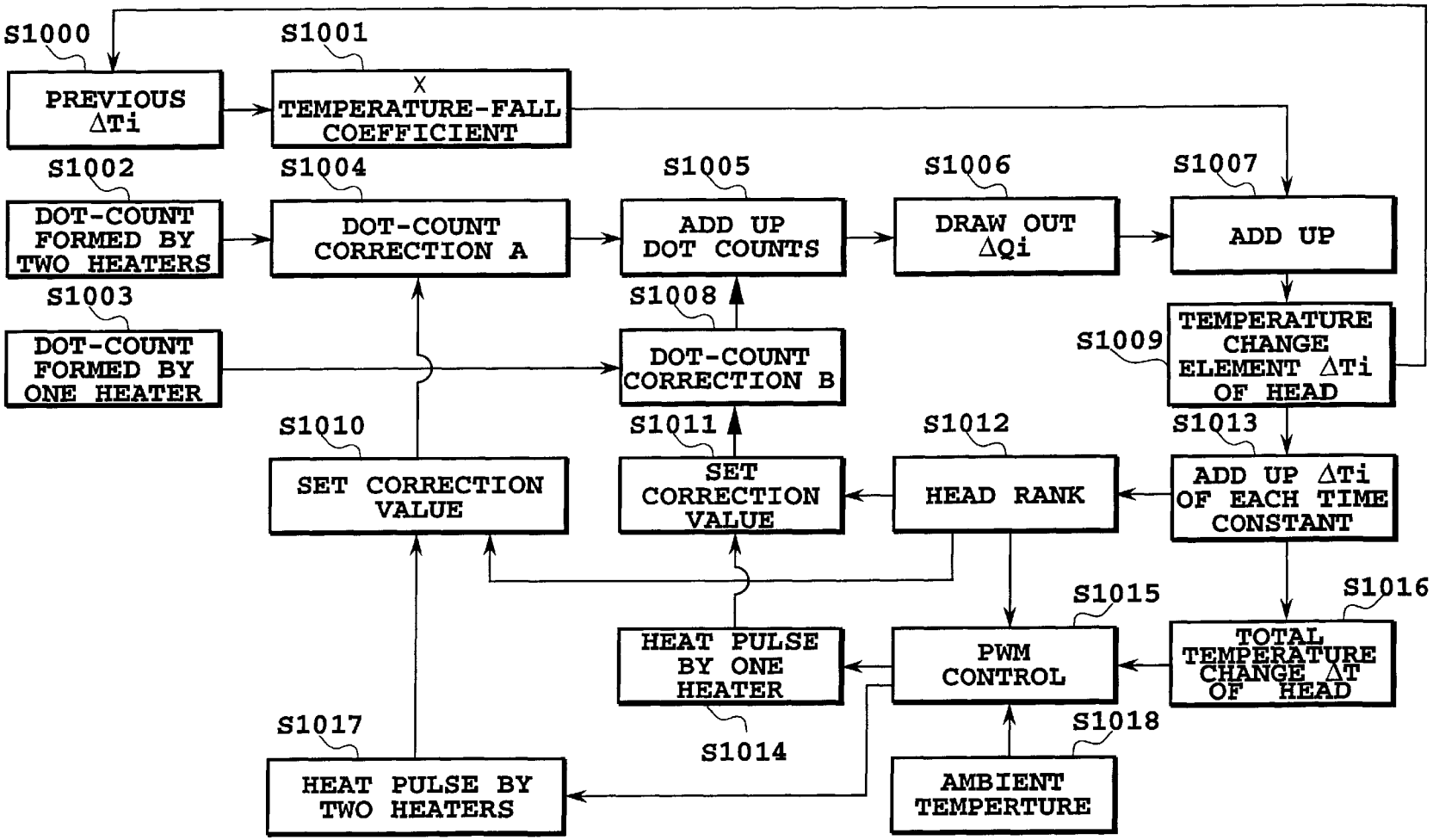
FIG. 7 is a schematic block diagram showing a feedback control system or a controlling procedure that adopts a computation for temperature estimation according to the first embodiment of the present invention.

Here, reference numeral 800 denotes a controller, which comprises a microcomputer-type CPU 801 that executes a control sequence shown in FIG. 7, a ROM 803 that stores a program corresponding to the control sequence and tables required for execution of the program, and also other fixed data, and a RAM 805 that provides an image data processing area, a working area and so on.

Reference numeral 810 denotes a host device for supplying image data (which can be an image data reading section apart from a computer that processes data including image to be printed), and the image data, other commands, status signal and so on can be transmitted and/or received by way of an interface 812 (I/F).

Numeral 820 denotes a switching device section for receiving commands from an operator, wherein the section includes a power switch 822, a print starting switch 824, a suction recovery switch 826 for instructing a recovery of suction of recording medium or the like. Numeral 830 denotes a group of sensors for detecting the state of device, including a photo-coupler 9 for detecting the home position, and a temperature-detecting sensor 5024 provided at a relevant portion to detect the ambient temperature.

Reference numeral 840 denotes a head driver to drive the ejection heaters in response to the print data or the like.

Numeral 852 denotes a driver for driving the main scanning motor 6. Numeral 860 denotes a sub-scanning motor used for transmitting a printing medium P, whereas 854 denotes its driver.

FIG. 7 shows a temperature estimation computing system according to the present embodiment or a process thereof for the estimation of temperature. In the figure, the blocks may compose a procedure of the processing operation that executes the controller 800, and at least one part thereof can be formed by hardware adopting a logic circuit.

In the present embodiment, a change of temperature ΔT of the print head is controlled by using, for example, 6 temperature-change elements ΔTi(i=1, 2, 3, 4, 5, 6) each having a time constant (hereinafter also referred to just as a thermal time constant) determined in accordance with a structure of the print head, a thermal capacity and a thermal conductivity of the components of the print head and the like. In other words, the change of temperature of the print head is controlled in the following manner.

First of all, the change of temperature is divided into six temperature-change elements to be managed independently in accordance with the respective thermal time constants. Thereafter, the value obtained by converting the amount of energy applied to the heating elements within a predetermined period of time to the temperature rise with respect to respective time constants and the values of respective falling elements obtained by computing the heat dissipation within the predetermined period of time determined in accordance with each time constant, are all added up to obtain the change of the temperature of the print head.

Namely, the change of temperature of the print head is obtained by the following equation;

$$\Delta T=\Delta T1+\Delta T2+\Delta T3+\Delta T4+\Delta T5+\Delta T6 \quad (1)$$

This procedure is executed in steps S1009, S1013 and S1016.

First, the predetermined period of time is set to 50 msec. In order to obtain a rise of temperature during this time interval, counting the number of formation of small dots only by use of one side heater, and the number of formation of the large dots by use of the both the ejection heaters is performed respectively in step S1003 and step S1002. In the present embodiment, the ejection heaters for respective colors of ink are formed on one heaterboard and the same type of heaters are used under the substantially same driving condition, so that substantially same amount of ink ejection is obtained for all the different colors, and thus it is not necessary to count the number of heating operations individually for respective colors. It is to be noted that although the heater used for forming small dots may be either one of the front and rear heaters, it is preferable to use always the front side one, by which relatively faster ink ejecting speed than the other is obtained. For this reason, the temperature estimating system according to the present embodiment is configured on the assumption that the ink ejection using only the rear-side heater is never performed.

A correction table for correcting each of the counted numbers of formation of dots is set in advance based on the head rank and the diving pulse (including pulse wave, pulse width, pulse height and so on) used within the before-mentioned predetermined time interval during which the number of formation of the dots are counted. This is because the applied amount of energy is computed from the used driving pulse and the head rank.

The head rank may be determined based on the resisting value of the rank heater 4007 provided on the heater board. Namely, the rank heater 4007 is formed by the same semiconductor layer molding process with that the ejection heaters, so that the characteristic of the ejection heaters, which are concurrently formed by the molding operation, can be estimated by detecting the resisting value of the rank heater 4007.

The correction value in steps S1010 and S1011 can be set in the following manner. Namely, the head having a medial resistance value within a plurality of heads during manufacturing thereof is first considered to be the head of the center rank. Thereafter, using the both front and rear ejection heaters included in one ejection heater section formed on the heater board of the head of the center rank, the value of power consumption after the heating operation is conducted by applying a pulse having a predetermined base width to "100", and the power consumption performed in respective rank of the head which is shown as a value relative to the value of "100" is set as the correction value for each rank. Here, if the voltage applied to the ejection heater is Vh, the pulse width of the front-side heater is Pf, the pulse width of the rear-side heater is Pb, the length and the width of the front-side heater are Lf and Wf respectively, the length and the width of the rear-side heater are Lb and Wb respectively, the thickness of the heaters is d, and the comparative electric resistance is σ, then the consumed power W is obtained by the following formula;

$$W=Vh^2\times pf/[\sigma\times Lf/(Wf\times d)]+Vh^2\times pb/[\sigma\times Lb/(Wb\times d)]=[Vh^2/(\sigma/d)]\times[pf\times(Wf/Lf)+pb\times(Wb/Lb)] \quad (2)$$

The most important and critical parameter within the parameters that vary in accordance with inconsistency of the condition during the molding process is the resisting rate σ. Further, if the length and the width of the rank heater are Lr and Wr respectively, the thickness thereof is d, and the comparative electrical resistance is σ, then the resisting rate Rr is obtained by;

$$Rr=\sigma\times Lr/(Wr\times d) \quad (3)$$

Then, $$\sigma/d=Rr\times Wr/Lr \quad (4)$$

Accordingly, the equation (2) will be;

$$W=[Vh^2/(Rr\times Wr/Lr)]\times[pf\times(Wf/Lf)+pb\times(Wb/Lb)] \quad (5)$$

Here, the difference between the length and width of the front-side, rear-side, and rank heaters are respectively set as;

$$\beta f=Wf/Lf \quad (6)$$

$$\beta b=Wb/Lb \quad (7)$$

$$\beta r=Wr/Lr \quad (8)$$

Then, the equation (5) will be;

$$W=[Vh^2/(Rr\times\beta r)]\times(pf\times\beta f+pb\times\beta b) \quad (9)$$

Here, if the rank heater resisting value of the center rank is Rinit, the basic pulse width is Pinit, then, if a constant to satisfy the following equation is set to be a;

$$100=a\times[Vh^2/(\mathrm{Rinit}\times\Delta r)]\times\mathrm{Pinit}\times(\beta f+\beta b) \quad (10)$$

Then, the correction value Kl of the large dots will be;

$$Kl=a\times[Vh^2/(Rr\times\beta r)]\times(Pf\times\beta f+pb\times\beta b) \quad (11)$$

-continued $$= 100 \times (R_{init} / Rr) \times (pf \times \beta r + pb \times \beta b) / [P_{init} \times (\beta f + \beta b)]$$

Further, the correction value Ks of the small dots can be obtained by replacing the heat pulse time Pb of the rear-side heater with "0" in the equation (11) as shown below;

$$Ks=100\times(\mathrm{Rinit}/Rr)\times pf\times\beta f/[\mathrm{Pinit}\times(\beta f+\beta b)] \quad (12)$$

In the present embodiment, the correction value is set corresponding to the rate of the power consumption at the heating operations. This is because the power consumed within the predetermined period of time can be readily related to a temperature-rise element ΔQi having the time constant i and contributing to the rise of temperature within the predetermined period of time. Namely, a temperature-rise element ΔQi within the predetermined period of time in accordance with the number of heating operations Hl by use of the both ejection heaters within the predetermined period of time and the number of heating operations Hs by use of one ejection heater within the predetermined period of time can be obtained by the following equation by use of a function Fi for each time constant;

$$\Delta Qi=Fi(Hl\times Kl+Hs\times Ks) \quad (13)$$

It is preferable that the function Fi for each of the time constants used here is held as a look-up table in the system so as to reduce the load applied to the controller. These processes are performed at steps S1004, S1008, S1005 and S1006.

The temperature-rise element ΔTi(n) of the print head at the current stage can be obtained by the following equation in accordance with the thus obtained temperature-rise element ΔQi within the predetermined period of time and the temperature-rise element ΔTi(n-1) of the print head accumulated by the preceding stage;

$$\Delta Ti(n)=\Delta Ti(n\text{-}1)\times Di+\Delta Qi \quad (14)$$

Here, Di is a coefficient which is used for each temperature-fall element of time constant, and is related to the temperature-fall due to heat dissipation for each predetermined period of time, and is called a temperature-fall coefficient just for convenience. This coefficient is the one that reduces the temperature-change element ΔTi of the print head in a case in which no heat is applied to the print head. Namely, this coefficient is more than 0 and less than 1 (0<Di<1). These processes are performed in steps S1000, S1001, S1007 and S1009 in FIG. 7. Then, by adding the value ΔTi obtained in step S1009 to all the time constants in the step S1016, the rise of temperature of the print head is computed to be ΔT as shown in the following equation.

$$\Delta T=\Delta T1+\Delta T2+\Delta T3+\Delta T4+\Delta T5+\Delta T6 \quad (15)$$

By the thus obtained ΔT and the ambient temperature obtained in step S1018, PWM (Pulse-Width Modulation) control, in which the pulse to be used is precisely selected in steps S1015, S1014 and S1017, is performed for the case that only one ejection heater is driven and the case that the both ejection heaters are driven.

Here, for executing the PWM control, it can be arranged such that the heat pulse is of a single pulse, and the pulse width of the singe pulse is modulated. However, it can also be arranged such that the heat pulse is of a double-pulse (divided pulse), and the pulse is modulated, so that the ejection amount is controlled to be constant.

Figure 8:
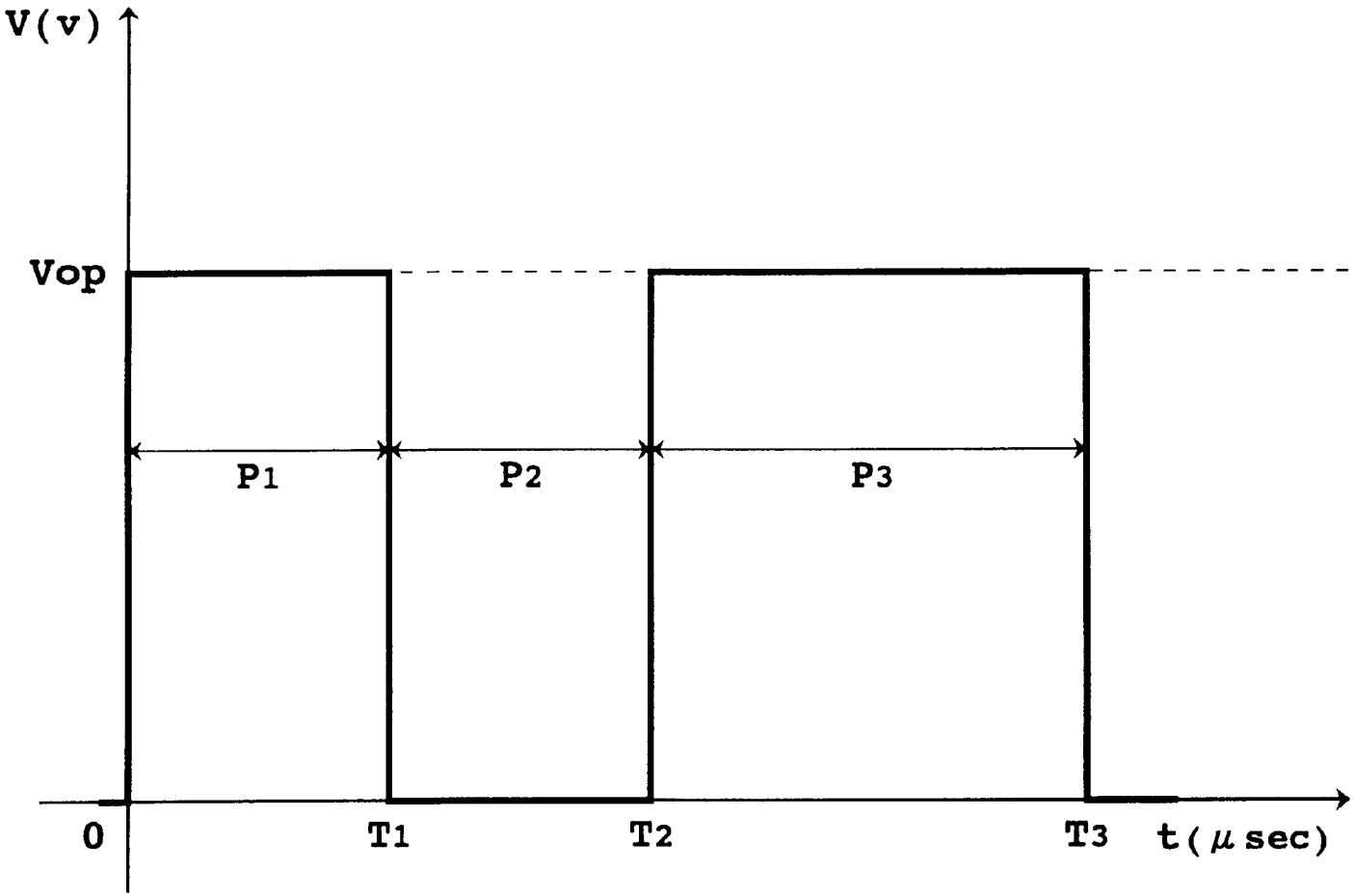
FIG. 8 is an explanatory view showing a PWM (Pulse-Width Modulation) control applied to the divided pulses adopted in the first embodiment.

The above-mentioned driving mode is now briefly explained with reference to FIG. 8. In this same figure, Vop denotes a driving voltage to be applied to the ejection heater, P1 denotes the pulse width of a first pulse in a plurality of divided heat pulses (hereinafter referred to just as a pre-pulse). P2 denotes an interval time, P3 denotes a pulse width of a second pulse (hereinafter referred to just as a main pulse). T1, T2 and T3 denote timing for determining P1, P2 and P3, respectively. The PMW ejection amount control is briefly divided into two methods; one is a pre-pulse-width modulation driving method in which T1 is modulated while T2 and T3 are fixed, whereas the other is an interval width modulation driving method for modulating (T2−T1) while T1 and (T3−T2) are fixed.

Figure 9:
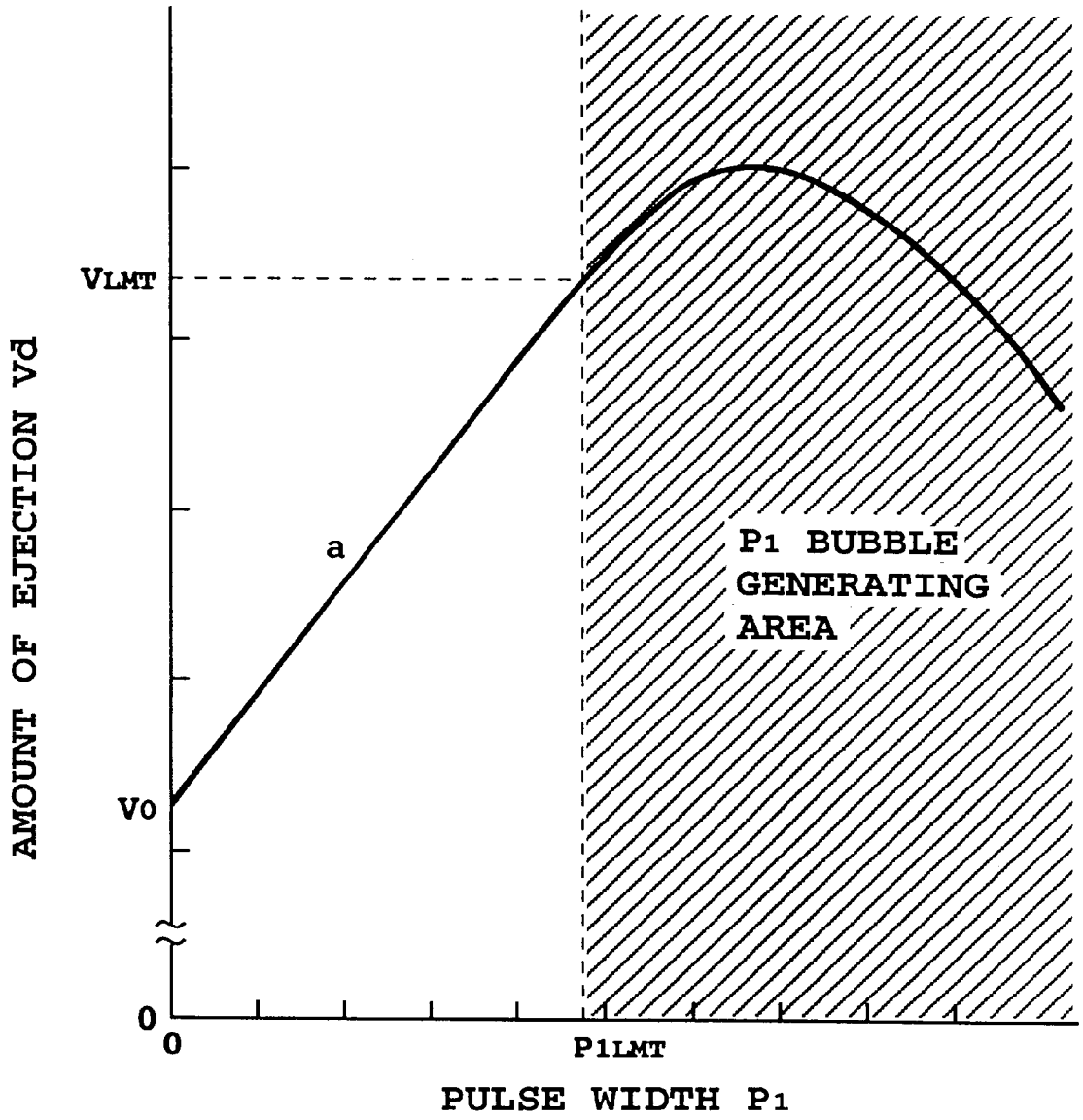
FIG. 9 is a line graph showing the dependency of the estimating amount on a first pulse (pre-pulse) of a plurality of divided pulses.

The transition of the ejection amount due to the former controlling method is indicated by a line graph as shown in FIG. 9. The ejection amount is increased in accordance with an increase of T1, and after passing over one point, it goes into the area in which a bubble generating phenomenon occurs due to the pulse of P1. By this driving method, it is enabled to make the transition of ejection amount have a linear characteristic with respect to the modulation of the T1 by optimizing the T1 setting area, to thereby facilitate the control.

Figure 10:
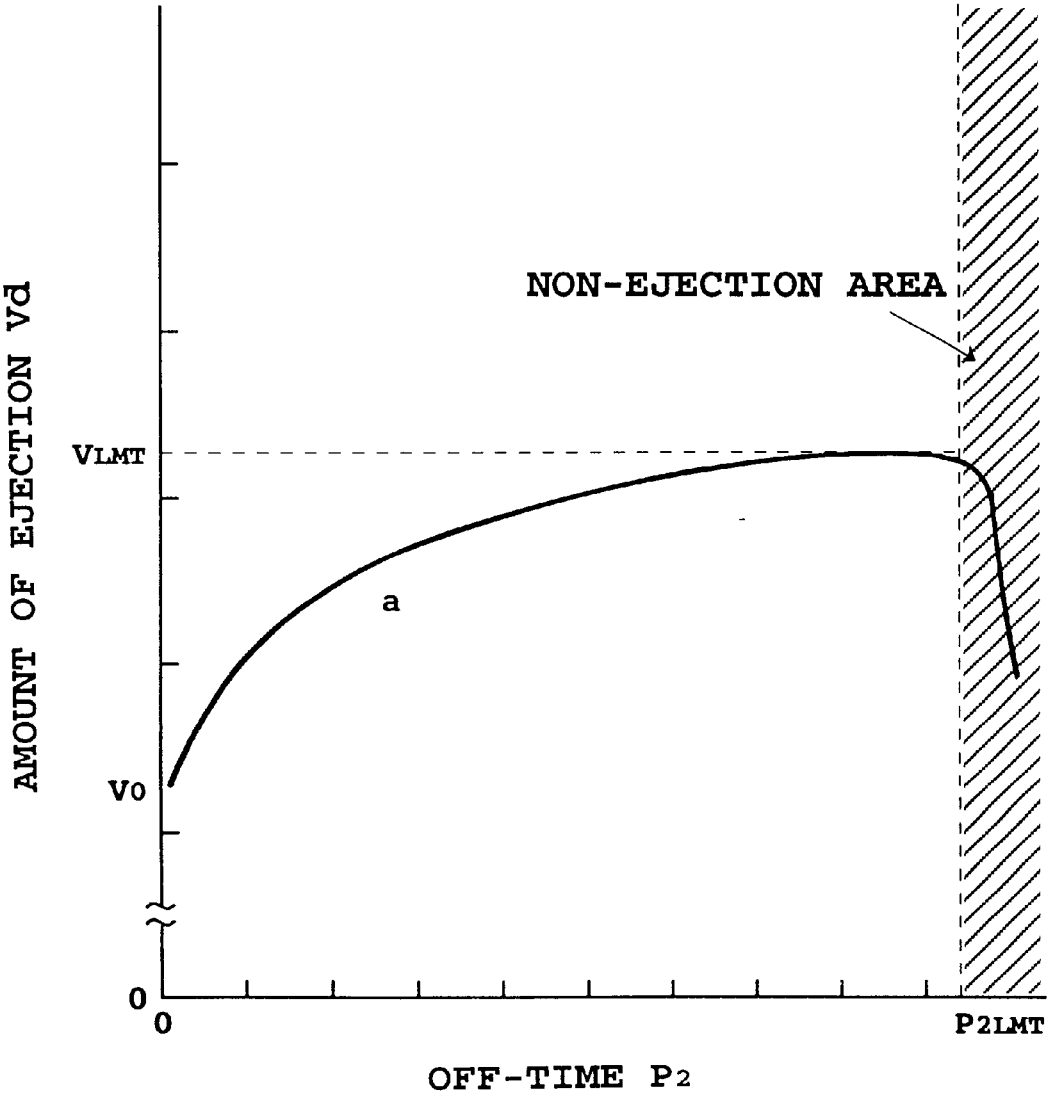
FIG. 10 is a line graph showing the dependency of the ejecting amount on an interval time.

The transition of the ejection amount due to the latter controlling method is indicated by a line graph as shown in FIG. 10. The ejection amount is increased in accordance with an increase of the interval, and after reaching one point, it goes into the area in which no bubble-generating phenomenon occurs any longer. In this driving method, the rise of temperature of the print head causes a critical problem, and thus in a control method in which the pulse width is reduced in a single pulse mode in the high temperature area, and the energy to be applied is reduced to control the rise of temperature, it can be executed by reducing (T2−T1) towards the temperature rising direction, and reducing the T1 from the timing at which (T2−T1) becomes 0, so that the pulse wave is modulated with the continuation thereof being maintained. The present embodiment can be executed by either one of the driving methods in accordance with a manner explained later, and can be executed also by a combination of the both driving methods in the same manner.

Note that when the temperature of the ink is low, the reduced ejection amount due to the low temperature cannot be fully compensated only by an increased ejection amount caused in accordance with the PWM driving method. In this case, the ink-ejection amount is increased by raising the temperature through driving of the temperature-keeping heater.

Figure 11:
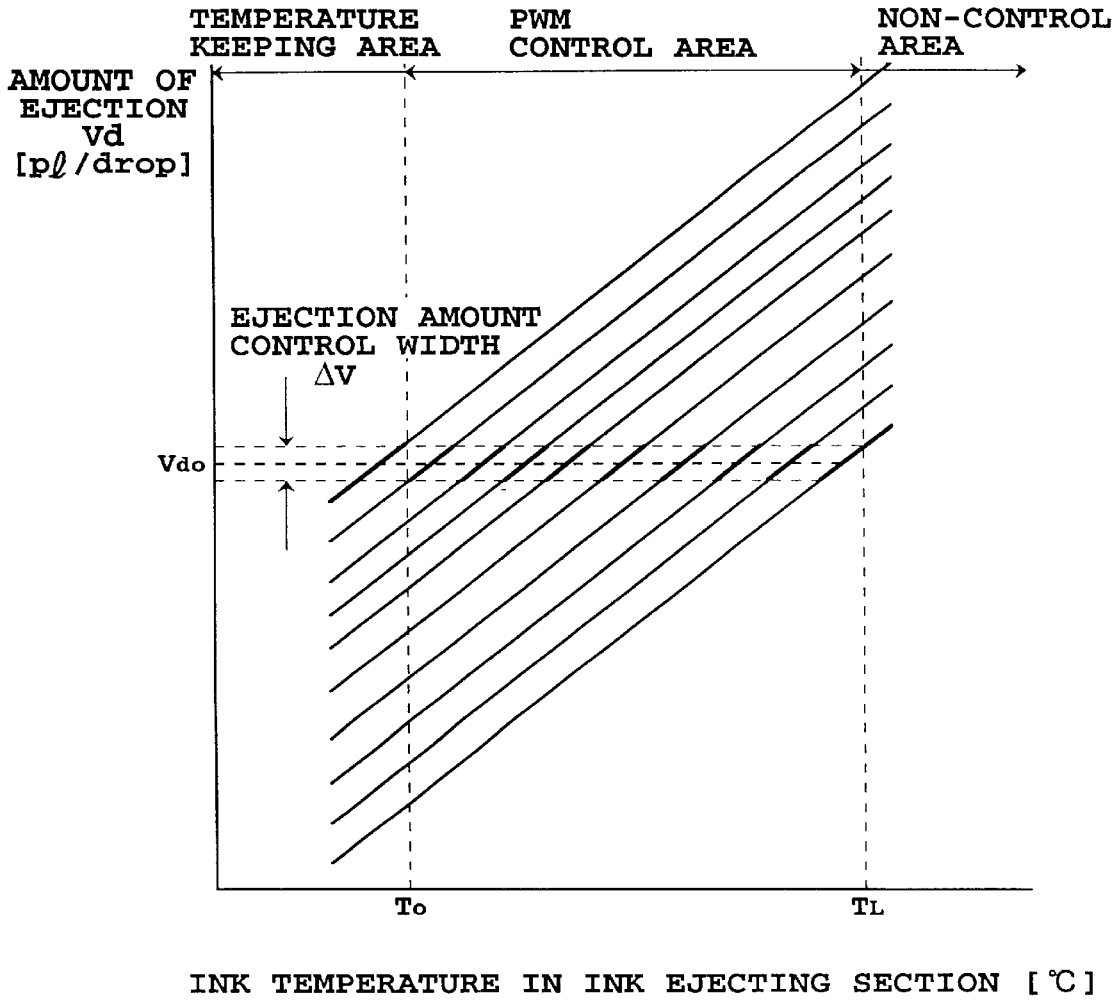
FIG. 11 is an explanatory view concerning a control of the ejecting amount.

FIG. 11 shows an aspect in which actual controlling operations are executed by applying the above-mentioned relationship. In the same figure, when the temperature is lower than T0, the print head should be heated up by the sub-heaters 4005 and 4006, and maintain the thus raised temperature. Accordingly, the Pwm control, which is an ejection amount controlling operation in accordance with the ink temperature, is performed at the temperature higher than T0. In FIG. 11, the temperature region which is indicated as the PWM controlling area is the region in which a stable ink ejecting operation is enabled, wherein in the present embodiment, the ink temperature is within the range between 24 and 54° C. In the same figure, the relationship between the ink temperature and the ink ejection amount in the case that the pre-pulse is varied at different plural steps is shown, wherein even when the ink temperature at the ejection heater section is varied, by changing the pulse width of the pre-pulse at each temperature step width ΔT in accordance with the ink temperature, the ink ejection amount can be controlled within the ejection amount controlling width ΔV with respect to the target ejection amount Vd0.

Further, in the present embodiment, since the required energy to eject ink varies due to a variation of the resistance value of each heater, which is caused by inconsistency of the head manufacturing operation, as mentioned above, the a heads are divided into a plurality of ranks and pulse groups to be used for the PWM control are determined in step S1012 in accordance with the thus divided ranks.

As explained heretofore, in the present embodiment, first, the heat pulse for a case in which only one of the ejection heaters is driven to eject relatively small amount of ink, and that for a case in which both the heaters are for ejecting operation are driven to eject relatively large amount of ink are determined with respect to both ΔT and the detected ambient temperature, and thereafter, the correction values are determined in accordance with the ranks of each head for correcting the both cases above, so that stable ejecting operations of small amount of ink and of large amount of ink are enabled.

[Second Embodiment]

In the aforementioned first embodiment, the temperature to be controlled is divided per each time constant to manage the temperature, whereas in this second embodiment, the nearby time constants are classified into the same group, and further, the effect of the rise of temperature within a predetermined time period and its reduction in accordance with the lapse of time are set in a look-up table, and a configuration capable of coping with the ejecting operation of large and small amounts of ink is explained with reference to this look-up table.

According to the temperature estimating method of this embodiment, temperature-change element is divided into two groups; one having a long thermal time constant and the other having a short thermal time constant (hereinafter referred to just as a long range and a short range, respectively). In the long range, a predetermined time interval is set to be one second, while in the short range, a predetermined time interval is set to be 50 millisecond. The look-up table copes with the respective ranges. The look-up table for each of the two ranges becomes a table for showing the number of heating operations performed by two heaters at a predetermined time interval (1 second for the long range, and 50 millisecond for the short range), and the relation between the rise of temperature contributed by the number of concurrent heating operations , and the rise of temperature contributed within a predetermined time lapse after the heating operations. The predetermined time lapse according to the present embodiment is 512 seconds for the long range, and 10 seconds for the short range, during which periods these ranges are controlled.

In other words, the look-up table for the long range corresponds to the function of the following equation, if the rise of temperature caused by the number of concurrent heating operations Hl at the time lapse t is ΔTL;

$$\Delta TL=FL(Hl,\ t) \tag{16}$$

On the other hand, the look-up table for the short range corresponds to the function of the following equation, if the rise of temperature caused by the number of concurrent heating operations HS at the time lapse t is ΔTS;

$$\Delta TS=FS(HS,\ t) \tag{17}$$

By use of these computing tables, the computation for forming large and small dots can be executed.

Figure 12:
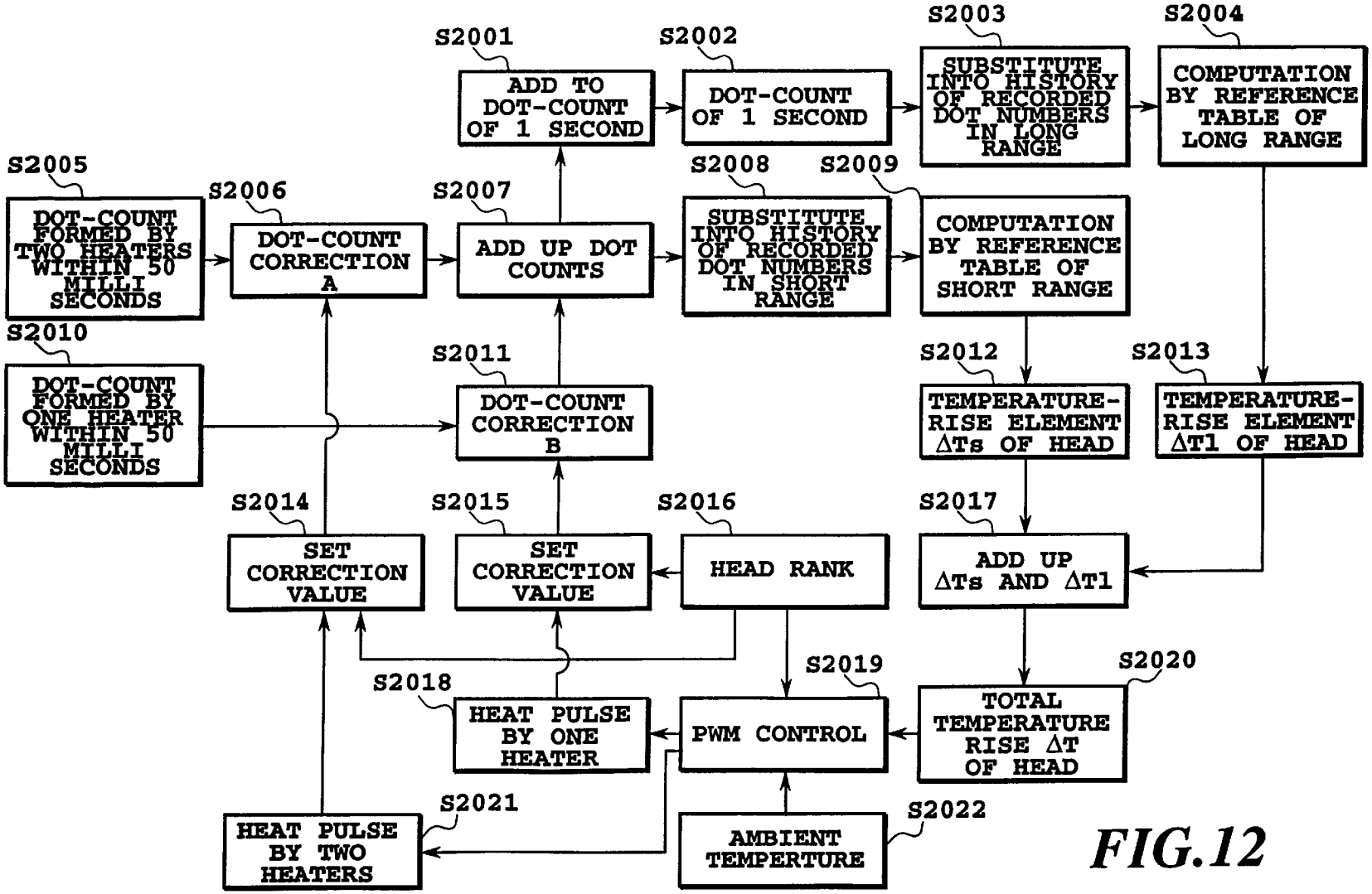
FIG. 12 is a schematic block view showing a feed-back control system or a controlling procedure that adopts a computation for temperature ejection according to the second embodiment of the present invention.

FIG. 12 shows a computing system or process for estimating temperature according to the present embodiment. The blocks in the figure can be components, as in the first embodiment, for a processing procedure executed by the controller 800, or at least same of those blocks can be configured by a hardware that uses a logic circuit.

Here, since steps S2014, S2015, S2016, S2018, S2019, S2020, S2021 and S2022 are same as steps S1010, S1011, S1012, S1014, S1015, S1016, S1017 and S1018 of the first embodiment, the explanation for each step is omitted. Further, as steps S2005, S2006, S2007, S2010 and S2011 are same as steps S1002, S1004, S1005, S1003 and S1008 of the first embodiment, except that these steps are for processing the short range.

The temperature estimation according to the present embodiment is configured to store the history regarding the short range. The history is made up by storing the number of heating operations from 0 second to less than 10 seconds at every 50 milliseconds. In other words, the number of heating operations to be stored is 200. If the time lapse is ts second (ts=0, 0.05, 0.10, . . . , 1.00), and the row of the stored number of heating operations is HS [ts/0.05), then in step S2008, ts that fulfills the following equation is decremented by 0.05 at each step from 1.00 down to 0.05 with respect to the-number of heating operations H1 obtained in step S2007;

$$HS[ts/0.05]=HS[ts/0.05-1] \tag{18}$$

And thereafter the following is computed;

$$HS[\mathbf{0}]=H\mathbf{1} \tag{19}$$

On the other hand, in the present embodiment, there is provided a counter for storing the numbers of heating operations per 1 second for the long range. If the count value cause this counter is H12, the summation in the following equation is performed in the step S2001;

$$H\mathbf{12}=H\mathbf{12}+H\mathbf{1} \tag{20}$$

The counted value when this process is performed 20 times becomes the number of heating operations per 1 second. Namely, when this process is performed 20 times, the process in step S2002 is executed. If the lapse of time is t1 second, (ts=1, 1, 2, . . . , 512), and the row of the stored number of heating operations is HL[t1], then in step S2003, t1 that fulfills the equation (21) is decremented by 1 ROM 512 down to 1 in step S2003 with respect to the number of heating operations H12 obtained in step S2002;

$$HL[t\mathbf{1}]=HS[tl-1] \tag{21}$$

Therefore, the counted value H12 is cleared by the following equation (22)

$$HL[\mathbf{0}]=H\mathbf{12} \tag{22}$$

Next, with respect to the history stored in steps S2003 and S2008, look-up tables for respective long and short ranges are referred in steps S2004 and S2009, and the following computation is executed in steps S2012 and S2013, respectively;

$$\Delta T\mathbf{1}=FL(HL[\mathbf{0}],\mathbf{0})+FL(HL[\mathbf{1}],\mathbf{1})+\ .\ .\ .\ +FL(HL[\mathbf{512}],\mathbf{512}) \tag{23}$$

$$\Delta Ts=FS(HS[\mathbf{0}],\ 0\times0.05)+FS(HS[\mathbf{1}],\ 1\times0.05)+\ .\ .\ .\ +FS(HS[\mathbf{20}],\ 20\times0.05) \tag{24}$$

ΔT1 and ΔTs obtained by the above computation are added to each other in step S2017, and the rise of temperature (temperature change) of the head ΔT is obtained by the following equation.

$$\Delta T = \Delta T1 + \Delta Ts \quad (25)$$

The procedure thereafter is same as the procedure performed in the first embodiment.

[Third Embodiment]In the aforementioned embodiments, a combination of the heaters for forming large and small dots is of only one type. However, the present invention can be applied even to a system adopting many kinds of combination too. For example, in a case that the heaters are of different sizes in accordance with the respective type of ink, the number of heating operations for obtaining the large dots and that for obtaining the small dots are independently counted for each heater size, and by using the correction values calculated from the equations (11) and (12) with respect to each number of heating operations, it can be converted to the number of heating operations which is the base for all sizes of heaters. By this operation, the computing methods used in the first and second embodiments can be used without any modification.

Further, the concrete values applied in the above embodiments are all examples, and thus, it goes without saying that any relevant values can be applied.

(Further Descriptions)

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high-resolution recording.

A typical structure and operational principle thereof is disclosed in U.S. Pat. Nos. 4,723,129 and 4,740,796, and it is preferable to use this basic principle to implement such a system. Although this system can be applied to both of on-demand type and continuous type ink-jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces abrupt temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal, so that the ejection of liquid (ink) having a quick driving response can be achieved. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type-recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a component of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers, or other type of heater elements, or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the ambient temperature and are softened or liquefied in the ambient temperature. This is because in the ink-jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink-jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet apparatus having an ink-jet head provided with a plurality of heating elements for each respective ejection orifice, each said plurality of heating elements being combinable into groups of one or more heating elements and generating thermal energy used for ejecting ink, said ink-jet apparatus comprising:

counting means for counting a driving frequency within a predetermined period of time for each said group of heating elements selectively driven when ejecting ink;

correcting means for correcting the count value for each said group using a predetermined correction value that corresponds to a relative amount of energy applied to drive each said group;

combining means for summing the corrected count values resulting in a summed value; and temperature estimating means for estimating a change of temperature of said ink-jet head based on the summed value.

2. An ink-jet apparatus as claimed in claim 1, wherein said temperature estimating means determines, based on said summed value, an amount of energy applied to said ink-jet head within said predetermined period of time.

3. An ink-jet apparatus as claimed in claim 2, said temperature estimating means further comprising:

means for converting said summed value obtained by said correcting means into a set of i values $\Delta Qi$ ($i \geqq 1$) that correspond to a thermal amount applied to said ink-jet head within said predetermined period of time;

means for multiplying a predetermined value Di by a value $\Delta Ti(n-1)$ that corresponds to an accumulated thermal amount of said ink-jet head before said predetermined period of time;

means for adding each said value $\Delta Qi$ to a respective resultant value of said multiplying means;

means for recording a resultant value of said adding means as a set of values $\Delta Ti(n)$ that corresponds to an accumulated thermal amount of said ink-jet head; and means for calculating a change of temperature from said set of values $\Delta Ti(n)$.

4. An ink-jet apparatus as claimed in claim 1, said temperature estimating means further comprising:

means for obtaining a series of values of change of temperature of said ink-jet head at intervals corresponding to said predetermined period of time based on the summed value; and means for obtaining a total change of temperature of said ink-jet head by accumulating said series of values of change of temperature.

5. An ink-jet apparatus as claimed in claim 1, further comprising:

means for setting a driving condition of said plurality of heating elements based on said change of temperature within said predetermined period of time for each said respective group of heating elements.

6. An ink-jet apparatus as claimed in claim 5, said setting means further comprising:

means for changing the driving condition of said plurality of heating elements within said predetermined period of time for each said group of heating elements.

7. An ink-jet apparatus as claimed in claim 6, further comprising means for detecting an ambient temperature of said ink-jet head, wherein said changing means modifies the driving condition of said plurality of heating elements within said predetermined period of time for each said group of heating elements based on the ambient temperature.

8. An ink-jet apparatus as claimed in claim 5, said correcting means further comprising:

means for correcting said count value for each said group of heating elements based on the driving condition of said plurality of heating elements within said predetermined period of time.

9. An ink-jet apparatus as claimed in claim 1, wherein said heating elements are electrothermal transducers for causing film boiling of the ink through electrical conduction.

10. A method for estimating the temperature of an inkjet head provided with a plurality of heating elements for each respective ejection orifice, each said plurality of heating elements being combinable into groups of one or more heating elements and generating thermal energy used for ejecting ink, said method comprising:

counting a driving frequency within a predetermined period of time for each said group of heating elements which are selectively driven when ejecting ink;

correcting the count value for each said group using a predetermined correction value that corresponds to a relative amount of energy applied to drive each said group;

summing the corrected values resulting in a summed value; and estimating a change of temperature of said ink-jet head based on said summed value.

11. A method for the estimating temperature of an ink-jet head as claimed in claim 10, wherein said step of estimating a change of temperature determines, using said summed value, an amount of energy applied to said ink-jet head within said predetermined period of time.

12. A method for estimating temperature of an ink-jet head as claimed in claim 11, said step of estimating a change of temperature further comprising:

converting said summed value into a set of i values $\Delta Qi$ ($i \geqq 1$) that correspond to a thermal amount applied to said ink-jet head within said predetermined period of time;

multiplying a predetermined value Di by a value $\Delta Ti(n-1)$ that corresponds to an accumulated thermal amount of said ink-jet head before said predetermined period of time;

adding each said value ΔQi to a respective resultant value of the multiplying step;

recording a resultant value of said adding step as a set of values ΔTi(n) that corresponds to an accumulated thermal amount of said ink-jet head; and calculating a change of temperature from said set of values ΔTi(n).

13. A method for estimating temperature of an inkjet head as claimed in claim 10, said step estimating a change of temperature further comprising:

obtaining a series of values of change of temperature of said ink-jet head at intervals corresponding to said predetermined period of time based on the summed value; and obtaining a total change of temperature of said ink-jet head by accumulating said series of values of change of temperature.

14. A method for estimating the temperature of an inkjet head provided with a plurality of heating elements for each respective ejection orifice, each said plurality of heating elements being combinable into groups of one or more heating elements and generating thermal energy used for ejecting ink, said method comprising:

counting a driving frequency within a predetermined period of time for each group of heating elements which are selectively driven when ejecting ink, correcting the count value for each said group using a predetermined correction value that corresponds to a relative amount of energy applied to drive each said group;

summing the corrected values resulting in a summed value;

estimating a change of temperature of said ink-jet head based on said summed value, and setting a driving condition of said plurality of heating elements based on said change of temperature within said predetermined period of time for each said respective group of heating elements.

15. A method for estimating the temperature of an ink-jet head as claimed in claim 14, said setting step further comprising changing the driving condition of said plurality of heating elements within said predetermined period of time for each said group of heating elements.

16. A method for estimating the temperature of an ink-head as claimed in claim 15, further comprising detecting an ambient temperature of said ink-jet head, wherein said step of changing the driving condition modifies the driving condition of said plurality of heating elements within said predetermined period of time for each said group of heating elements based on the ambient temperature.

17. A method for estimating the temperature of an ink-jet head as claimed in claim 14, said correcting step further comprising:

correcting said count value for each said group of heating elements based on the driving condition of said plurality of heating elements within said predetermined period of time.

18. A method for estimating the temperature of an ink-jet head as claimed in claim 14, wherein said heating elements are electrothermal transducers for causing film boiling of the ink through electrical conduction.

* * * * *

UNITED STATES PATENT AND TRADEMARK OFFICE

CERTIFICATE OF CORRECTION

PATENT NO. : 6,302,509 B1
DATED : October 16, 2001
INVENTOR(S) : Osamu Iwasaki et al.

It is certified that error appears in the above-identified patent and that said Letters Patent is hereby corrected as shown below:

Column 1,
Line 59, "head" should read -- head. --.

Column 4,
Line 18, "printed" should read -- print --; and
Line 63, "contract" should read -- contact --.

Column 6,
Line 22, "5004" should read -- 5003 --.

Column 8,
Line 61, "$100 = a \times [Vh^2/(Rinit \times \Delta r)] \times Pinit \times (\beta f + \beta b)$ (10)" should read -- $100 = a \times [Vh^2/(Rinit \times \beta r)] \times Pinit \times (\beta f + \beta b)$ (10) --.

Column 9,
Line 59, "S1014" should read -- S1004 --; and
Line 64, "singe" should read -- single --.

Column 12,
Line 25, "the-number" should read -- the number --.

Column 13,
Line 7, "[Embodiment] In" should read -- [Embodiment] ¶ In --; and
Line 11, "tion" should read -- tions --.

Column 14,
Line 11, "be also" should read -- also be --;
Line 32, "type" should read -- types --; and
Line 39, "be also" should be -- also be --.

Column 17,
Line 27, "ink," should read -- ink; --.

UNITED STATES PATENT AND TRADEMARK OFFICE

CERTIFICATE OF CORRECTION

PATENT NO. : 6,302,509 B1
DATED : October 16, 2001
INVENTOR(S) : Osamu Iwasaki et al.

It is certified that error appears in the above-identified patent and that said Letters Patent is hereby corrected as shown below:

Column 18,
Line 2, "value, and" should read -- value; and --; and
Line 14, "head" should read -- jet head --.

Signed and Sealed this

Second Day of April, 2002

*Attest:*

*Attesting Officer*

JAMES E. ROGAN
*Director of the United States Patent and Trademark Office*